US009611061B2

(12) United States Patent
Eggersmann

(10) Patent No.: US 9,611,061 B2
(45) Date of Patent: Apr. 4, 2017

(54) DEVICE FOR OPENING BAGS IN MIXTURES OF WASTES AND METHOD THEREFOR

(71) Applicant: BRT Recycling Technologie GmbH, Ibbenbüren (DE)

(72) Inventor: Karlgünter Eggersmann, Marienfeld (DE)

(73) Assignee: KOMPOFERM GmbH, Marienfeld (DE)

( * ) Notice: Subject to any disclaimer, the term of this patent is extended or adjusted under 35 U.S.C. 154(b) by 0 days.

(21) Appl. No.: 14/820,683

(22) Filed: Aug. 7, 2015

(65) Prior Publication Data

US 2016/0114928 A1 Apr. 28, 2016

(30) Foreign Application Priority Data

Oct. 22, 2014 (EP) ..... 14003598

(51) Int. Cl.
*B65B 69/00* (2006.01)

(52) U.S. Cl.
CPC ..... *B65B 69/0008* (2013.01)

(58) Field of Classification Search
CPC ..... B65B 69/0008
USPC ..... 414/412
See application file for complete search history.

(56) References Cited

U.S. PATENT DOCUMENTS 4,995,770 A * 2/1991 Crane ..... B65B 69/0008 241/236
5,484,247 A * 1/1996 Clark ..... B65B 69/0008 414/412
5,551,826 A 9/1996 Todd
5,567,106 A * 10/1996 Gassner ..... B65B 69/0008 414/412
5,762,463 A * 6/1998 Bielagus ..... B65B 69/0008 241/186.35
5,829,943 A * 11/1998 Davis ..... B09B 3/0058 241/261
6,077,021 A * 6/2000 Roman ..... B65B 69/0008 414/412
6,079,929 A * 6/2000 Muma ..... B65B 69/0008 414/411
6,089,814 A * 7/2000 Bayer ..... B65B 69/0008 241/191

(Continued)

FOREIGN PATENT DOCUMENTS

EP 0686562 B1 10/1998
WO 9821102 A1 5/1998

OTHER PUBLICATIONS

European Patent Office, Search results on priority application, Dec. 16, 2014.

*Primary Examiner* — Kaitlin Joerger
(74) *Attorney, Agent, or Firm* — Laurence P. Colton; Smith Tempel Blaha LLC

(57) ABSTRACT

A device (1) for opening bags in mixtures of wastes has a first group of tearing elements (2) for transferring tearing forces to bags and a second group of tearing elements (2) for transferring tearing forces to bags. A drive power can move the groups of the tearing elements (2) in such a manner that relative movement between tearing elements (2) of different groups can generate tearing forces. The device has a drive control device configured to control the drive power of at least one group of tearing elements (2) as a function of the operating situation.

22 Claims, 7 Drawing Sheets

(56) References Cited

U.S. PATENT DOCUMENTS

| | | | | |
|---|---|---|---|---|
| 6,241,097 | B1 * | 6/2001 | Roman | B03B 9/06 209/3 |
| 7,497,337 | B2 * | 3/2009 | Tse | B02C 17/007 209/284 |
| 2010/0303591 | A1 * | 12/2010 | Mongstad | B65B 69/0033 414/412 |

* cited by examiner

DEVICE FOR OPENING BAGS IN MIXTURES OF WASTES AND METHOD THEREFOR

STATEMENT OF RELATED APPLICATIONS

This patent application claims priority on and the benefit of European Patent Application No. 14003598.1 having a filing date of 22 Oct. 2014.

BACKGROUND OF THE INVENTION

Technical Field

The present invention relates to a device for opening bags in mixtures of wastes and a method for opening bags in mixtures of wastes.

Prior Art

A device of the art at issue is, for example, known from the publication EP 0 686 562 B1. The device therein disclosed has groups of tearing elements, which may be moved in such a manner that tearing forces may be generated by relative movement between the tearing elements of different groups. In this instance, the tearing forces result from the fact that the distance between the tearing elements of different groups changes on the basis of the relative movement. In doing so, the tearing elements are suited to transfer the tearing forces to bags, which are provided in a mixture of wastes. This results from the fact that the tearing elements engage at the bags and ultimately tear the material of the bags because of the relative movement. For this reason, the tearing forces result from the drive power moving the tearing elements.

In addition, the tearing elements cause and/or support to convey the mixture of wastes through the device. In this instance, tearing the material of the bags may result from the individual tearing elements merely gripping onto the bags in the mixture of wastes. The high efficiency of the device or method of the art at issue, however, results largely from the relative movements of the tearing elements of individual groups in relation to one another. Only this relative movement achieves a satisfactory efficiency in regard to the energy input when opening the bags by tearing.

Tearing the material of the bags is to be understood as a tearing in the wider sense, meaning, that a slitting or cutting open of the bags may also occur in this instance, depending on how the specific contact between tearing element and bag materializes. In conjunction with the present invention, all of these processes, in which the tearing elements charge at the material of the bags and at least in places separate said material to open the bags, are, however, subsequently referred to as tearing processes and the forces transferred from the tearing elements to the bags are referred to as tearing forces.

According to the related art established according to the publication EP 0 686 562 B1, the tearing elements are moved in a type of "stop-and-go" operation. This means that a first group of tearing elements first stands still, while a second group of tearing elements moves, by means of which a relative movement between the tearing elements is generated. After a certain time or after running through a specific range of movements, the first group of tearing elements is now also actuated and, after a short common phase of movements, the movement of the second group of tearing elements is halted, by means of which a relative movement between the tearing elements of different groups is in turn generated.

Although it has been shown that bags may be efficiently opened in this manner, owing to the drive power according to the related art expended in this instance, the energy demand of such a device or of such a method is, however, still comparatively high.

BRIEF SUMMARY OF THE INVENTION

For this reason, the object of the present invention is to specify a device and a method for the art at issue, which requires a lower energy consumption via-à-vis the related art.

This object is achieved by a device and a method having the features of the independent claims. The features of the dependent claims concern advantageous embodiments.

According to the present invention it is provided that the drive power of at least one group of tearing elements is controlled as a function of the operating situation. While in previous devices of the art described at the outset the drive power is controlled according to a specified program, the device according to the present invention provides a drive control, which is capable to adapt the current power of the drive to the current operating situation.

Preferably, the control, in this instance, occurs as a function of the current waste amount stream. Controlling the drive power in such a manner lowers the drive power, if the device has to process comparably small waste amount streams. If higher waste amount streams accrue, for example, during peak-hours, the drive power is increased. It has been shown that hereby significant energy may be conserved vis-à-vis the devices according to the related art, in which the respective group of tearing elements is moved by a constant drive power.

In this instance, the control may either act upon the force, by which the tearing elements are moved, or upon the motion speed of the tearing elements. In the case of an advantageous embodiment, in which the tearing elements are situated in groups at preferably annular carrier elements rotated for moving the tearing elements, the control of the drive power may, in an advantageous manner, act upon the torque and/or the angular velocity of the rotation of the carrier elements.

Mass flow, for example, may be used as a control variable for the waste amount stream fed into the device. It is, however, also possible that another representative variable, which, for example, is based on the volume to be processed per time unit, is used.

Preferably, the device has furthermore a pressing device for pressing the mixture of wastes onto the tearing elements. Such a pressing device is able to ensure the contact between the bags to be opened and the tearing elements and, for this reason, a secure transfer of the tearing forces onto the bags. In this instance, the pressing device is advantageously an arrangement of individual pressing elements, which act individually upon the waste amount stream, for example, by a spring load regulated preferably in a hydraulic manner, for each single pressing element. This segmentation of the pressing device into single pressing elements has the advantage that, even in the case of an extremely heterogeneous composition of the mixture of wastes, a secure pressing is warranted in the areas of the waste amount stream assigned to the individual pressing elements, even if, for example, in-situ large, incompressible objects of individual pressing elements are pushed away from their tearing elements, since in this way adjacent pressing elements are not thereby affected.

Particularly in regard to the fact that possibly bulky and hard objects may be included in a mixture of wastes, it is advantageous, if individual pressing elements and/or the complete pressing device are designed in such a manner that they are able to give way to such extraneous materials. By doing so, a disturbance of the operation by a wedging of such extraneous materials between their pressing devices and the tearing elements may be effectively prevented. For this purpose, the pressing device or the individual pressing elements may, for example, have a particular, elastic bearing, which enables that, when such extraneous materials appear, the pressing device or the individual pressing elements enable the extraneous materials to pass the device by moving away from the tearing elements.

Furthermore, it may make sense that the device has a pressing control device, which enables to shift the pressing device selectively into a use state or a non-use state. In this instance, "use state" is to be understood as a state in which the waste amount stream is charged by the pressing device with a force acting in the direction of the tearing elements, while a "non-use state" is to be understood as a state in which the pressing device or the pressing elements at best form a rigid barrier as a delineation for the space available to the waste amount stream when passing the device. This, for example, may be the case, if individual, finger-like pressing elements, which, in the use state, exert an elastic or bouncing force onto the waste amount stream and, in this way, press said waste amount stream against the tearing elements, are, in a non-use state, moved or, in particular, swiveled, away from the tearing elements into a non-use position, which has a greater distance from the tearing elements than the position of the pressing elements in the use state.

Furthermore, it is advantageous that the device according to the present invention has a feeding device for feeding the mixture of wastes into the operating area of the tearing elements. This may be, for example, a push floor, which is typically referred to as a "walking floor." Such a feeding device is in particular useful when a feeding control device is provided, which is suited to control the feeding speed of the mixture of wastes.

In doing so, not only is the speed, by which the mixture of wastes is fed into the device according to the present invention, able to be adjusted in a useful manner to the current drive power, it is, furthermore, also possible to react, for example, to variations in the composition of the mixture of wastes and, depending on these variations, different conditions of feeding speeds and drive power may be realized.

For this purpose, a superordinate control device may preferably be provided serving to actuate the drive control device, the pressing control device and/or the feed control device. In this instance, the different control devices may be discrete devices connected merely by the necessary signal transmission paths, for example, to situate the respective control devices in the vicinity of the aggregates to be controlled, for example, electric engines of an actuator, such as torque engines. Alternatively, the individual controls may also be individual circuits on a circuit carrier, such as a circuit board or a chip. A software-based realization of the individual controls in a control, which is supported by a respective, intelligent computer or is programmable by a memory, is also possible.

For this purpose, the superordinate control is able to provide preferably different, selectively retrievable operation modes, in which the drive control according to the present invention and, if applicable, the advantageous feed and/or pressing control devices are actuated according to defined specifications or the drive power of the tearing elements and, preferably, of the pressing device and/or the feeding device are controlled or actuated according to particularly specified or specifiable control parameters.

In this manner, a special operating mode may, for example, be provided for processing mixtures of wastes abundant in waste-paper, in which both groups of tearing elements are moved simultaneously, and the movement is, however, actuated in such a manner that a relative movement between the tearing elements of different groups still results, and, at the same time, a pressing device is shifted to a use state. Furthermore, an operating mode for processing mixtures of wastes abundant in commercial waste, including, as a rule, a larger quantity of large objects than, for example, mixtures of wastes abundant in household refuse, may be provided, in which the pressing device, and both groups of tearing elements also featuring simultaneous movements of preferably variable speed, is shifted into a non-use state to enable that large objects pass the device without hindrance.

BRIEF DESCRIPTION OF THE DRAWINGS

In the following, the present invention is schematically illustrated in greater detail on the basis of FIGS. 1 through 7.

DETAILED DESCRIPTION OF PREFERRED EMBODIMENTS

Figure 1:
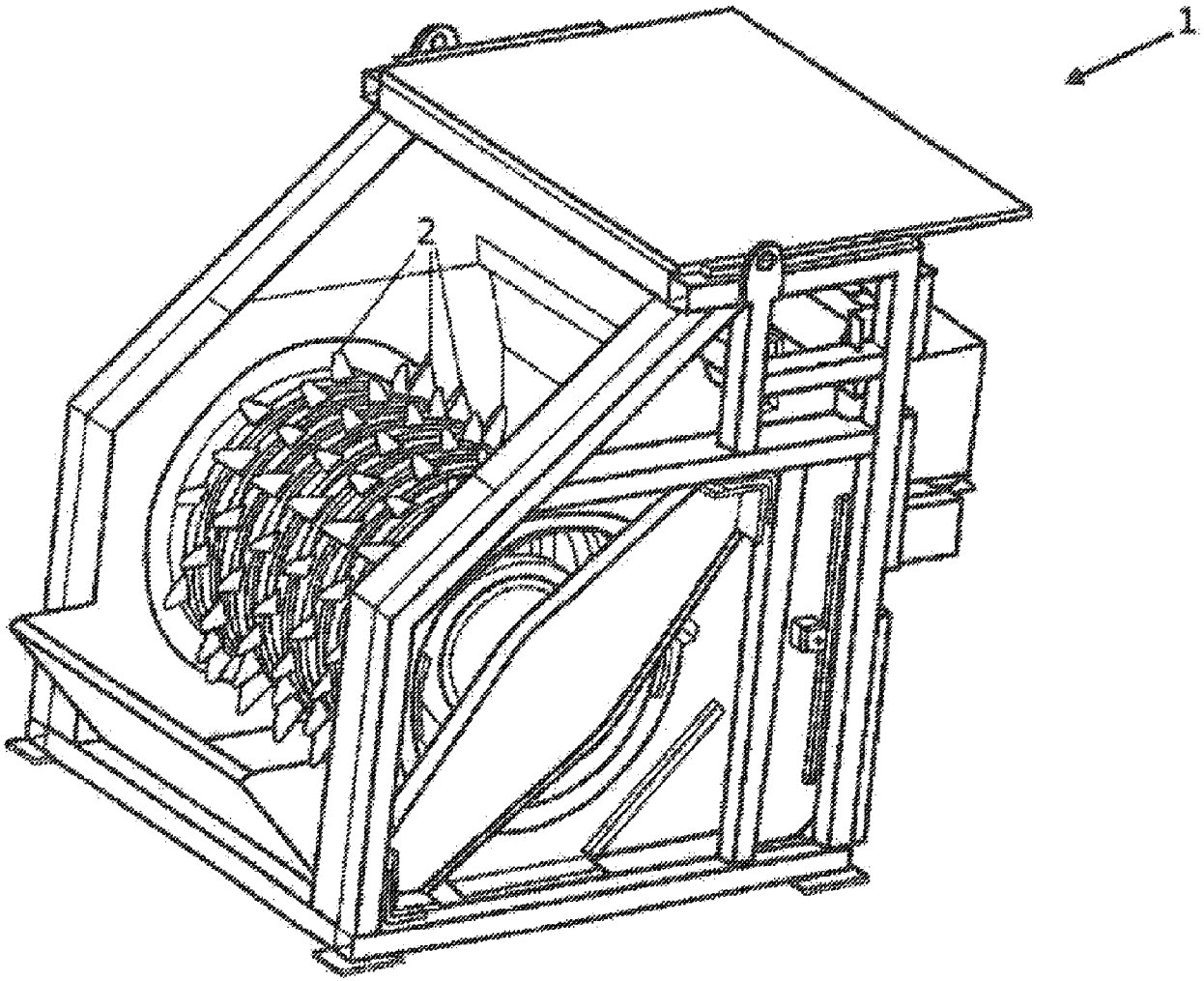
FIG. 1 shows a perspective view of an exemplary device according to the present invention.
Figure 2:
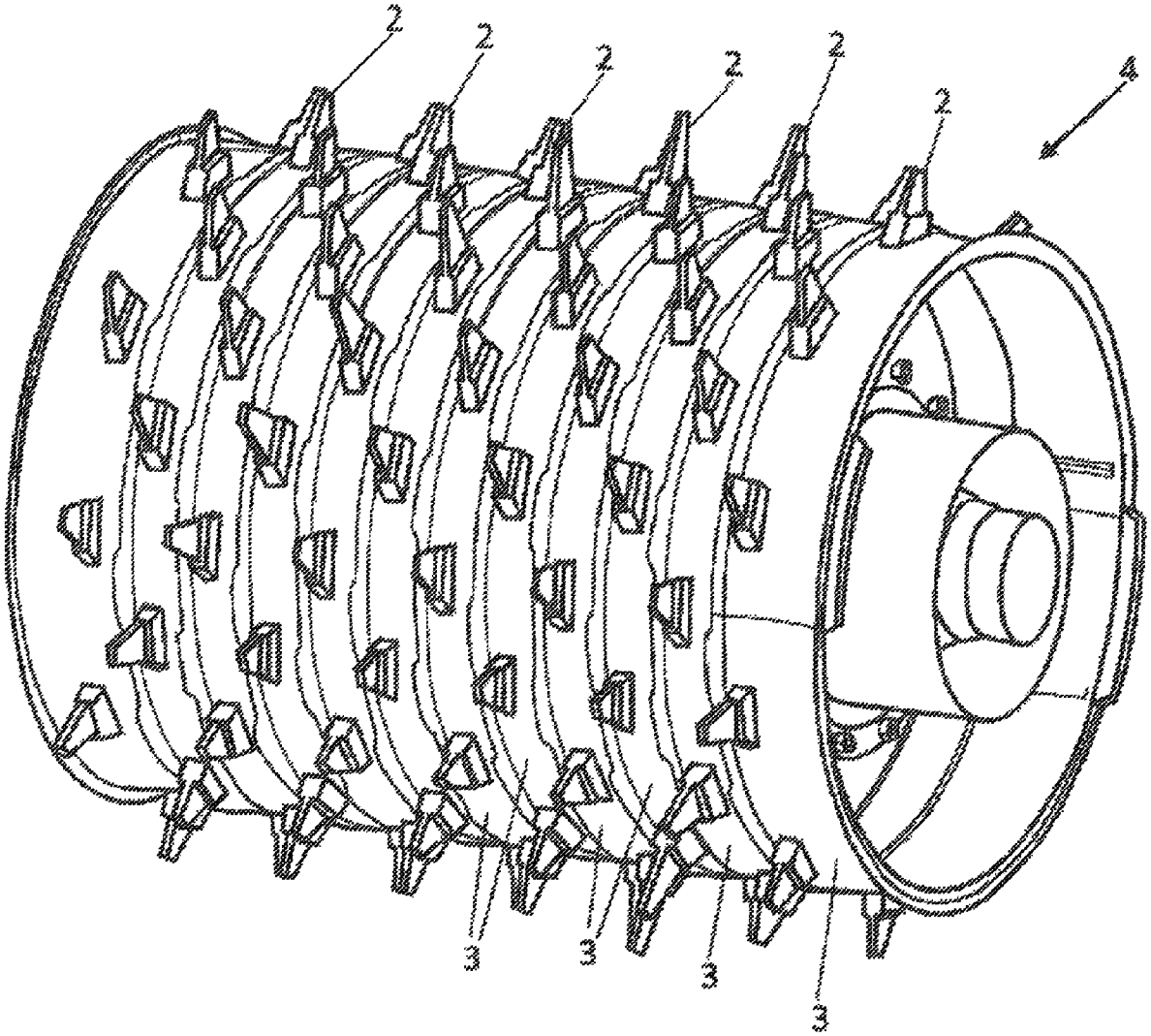
FIG. 2 shows a detailed view of the tearing elements housed in groups at the carrier elements of the device illustrated in FIG. 1.

Device 1 according to the present invention has a plurality of tearing elements 2. In this instance, tearing elements 2 are, in the case of exemplary device 1, situated in groups at annular carrier elements 3. Carrier elements 3 preferably form a cylindrical rotational solid 4, as it is shown in FIG. 2. Said cylindrical rotational solid is preferably designed in such a manner that adjacent carrier elements 3 may be moved relative to one another by a rotational speed difference. In doing so, it is enabled to carry out the method according to the present invention, which provides a relative movement between tearing elements 2 of different groups of tearing elements 2. This preferably may occur in that a group of tearing elements 2 situated on an adjacent carrier element 3 moves relatively to a group of tearing elements 2 situated on an adjacent carrier element 3, when carrier elements 3 are rotated by different rotational speeds. In this instance, it is also possible that a part of carrier element 3 stands still, while the remaining carrier elements 3 are rotated.

According to the present invention, now an actuation of the torque and/or the rotational speed moving individual carrier elements 3 is carried out as a function of the operational state of device 1. For this purpose, it is particularly advantageous if the control is carried out on the basis of the waste amount stream fed into device 1.

Figure 3:
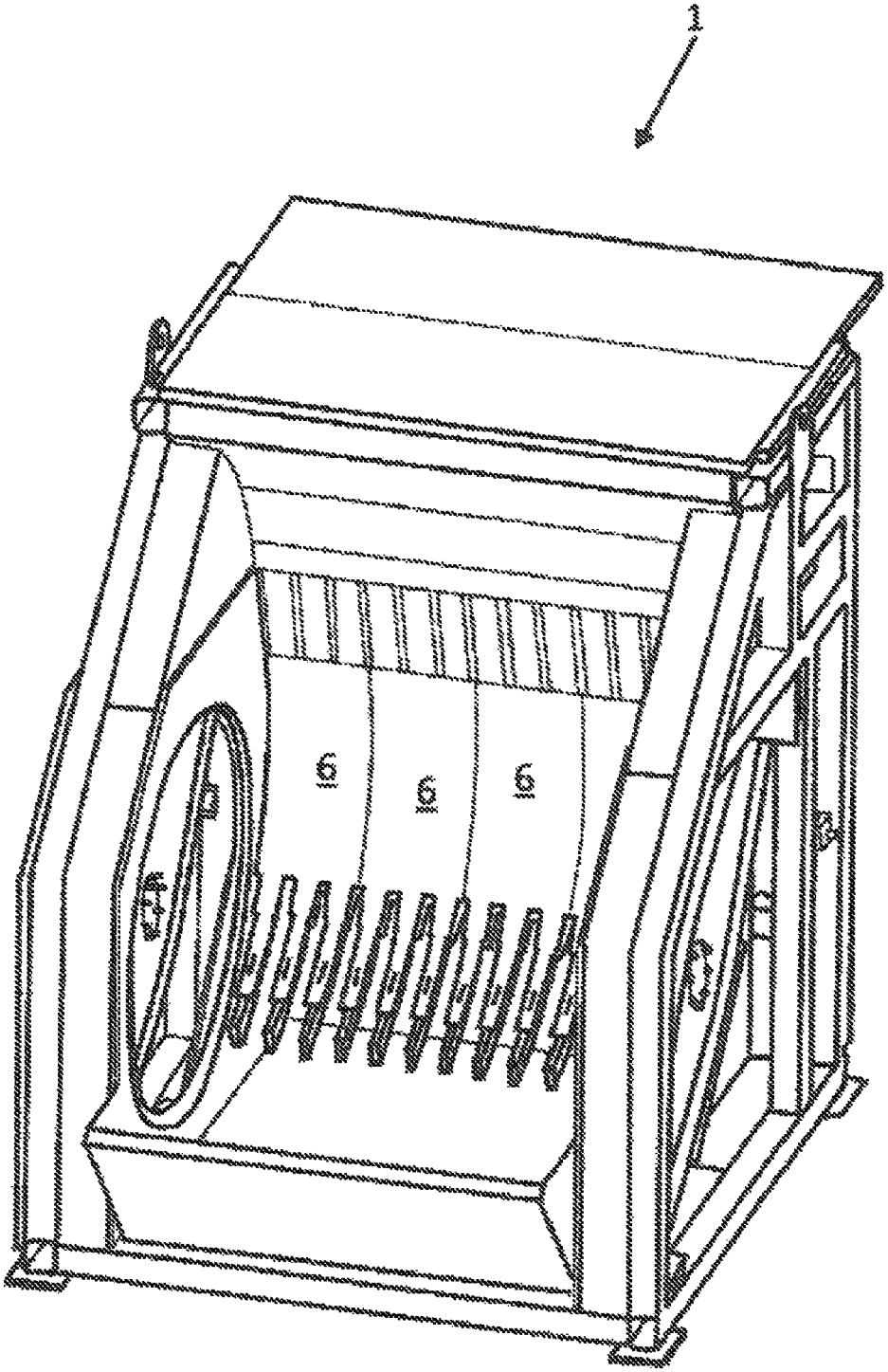
FIG. 3 shows a perspective illustration of an exemplary device according to the present invention, and the carrier elements having the tearing elements are not illustrated.
Figure 4:
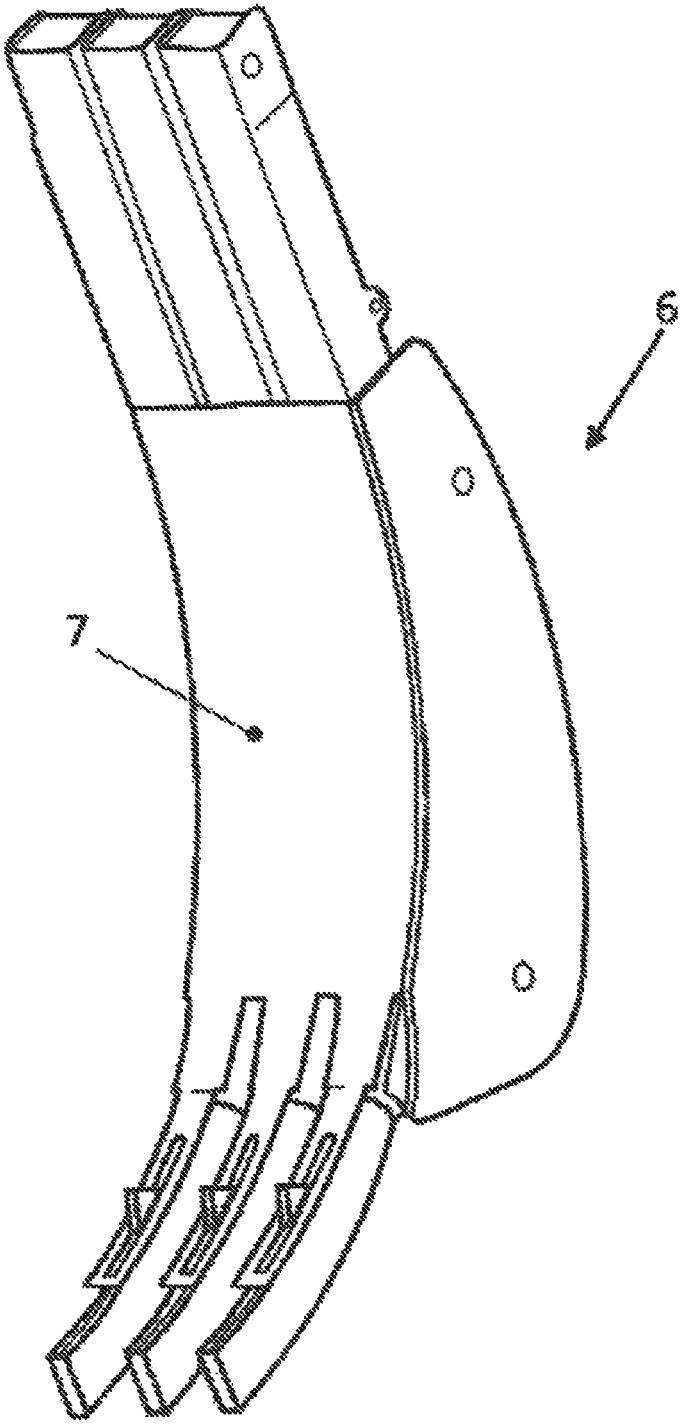
FIG. 4 shows a detailed view of a pressing element of the device illustrated in FIG. 3.
Figure 5:
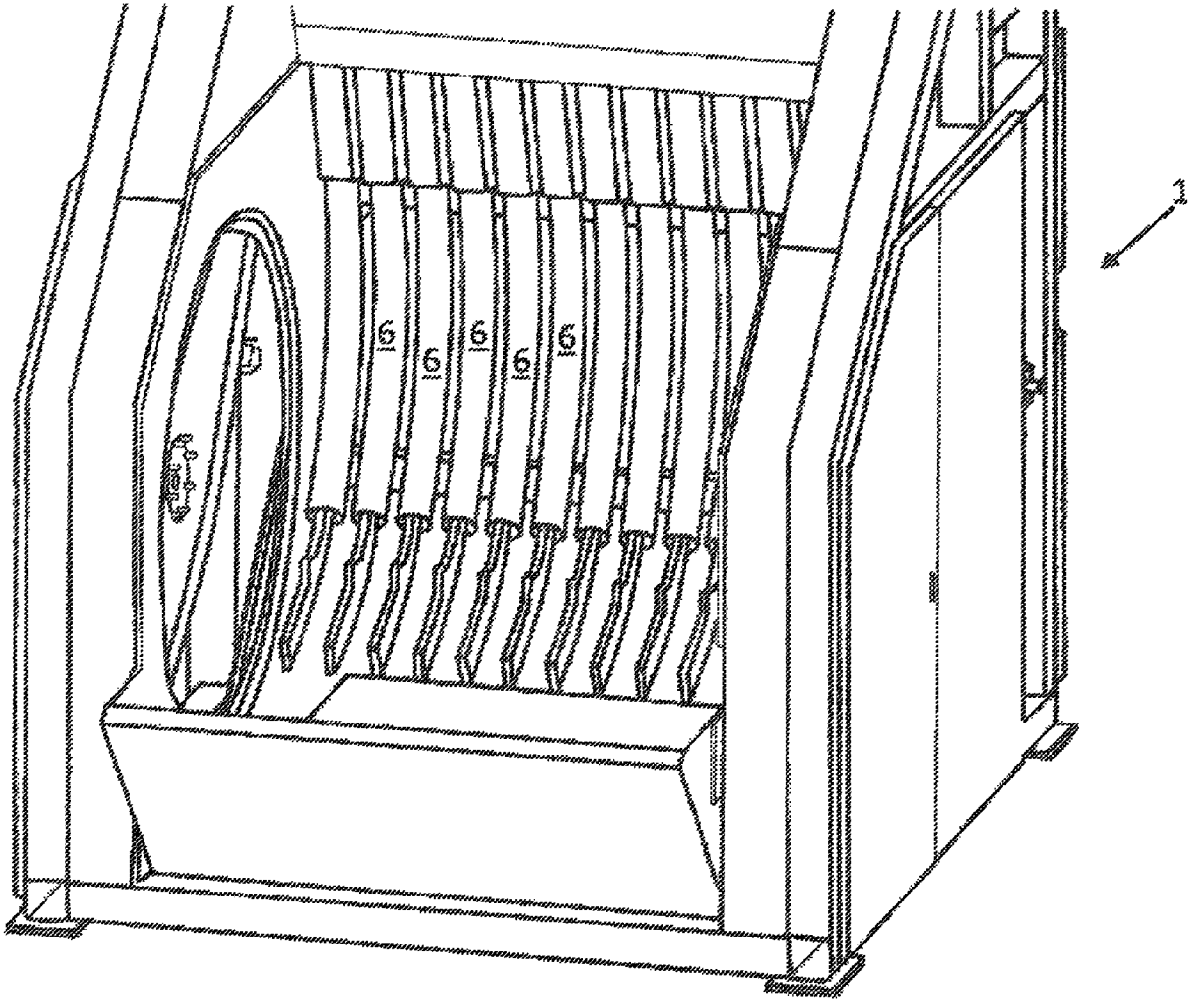
FIG. 5 shows an illustration corresponding with FIG. 3 of another exemplary device according to the present invention.
Figure 6:
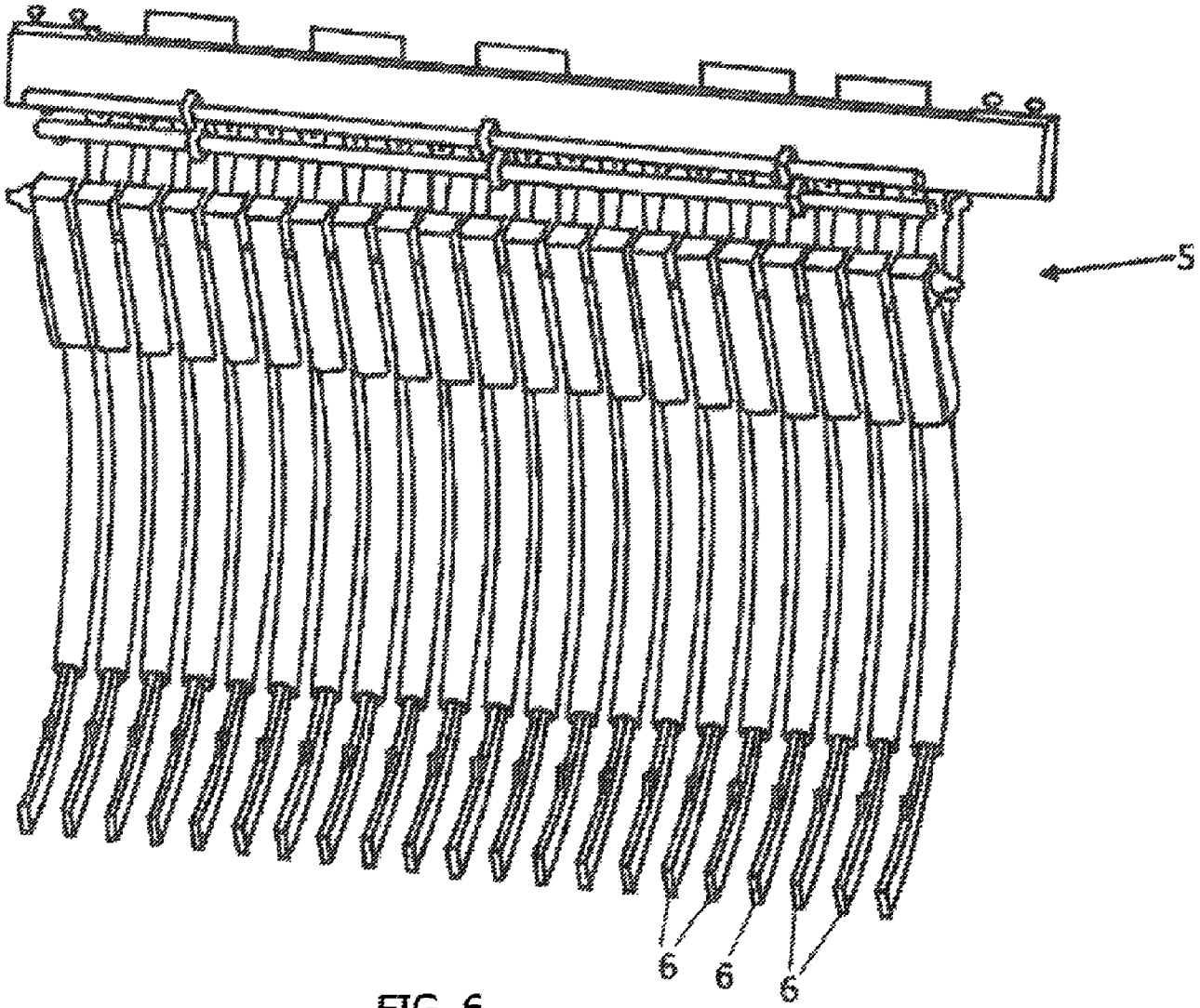
FIG. 6 shows a detailed view of the pressing device of the device illustrated in FIG. 5.

Preferably, the exemplary device according to the present invention has a pressing device 5, as it is illustrated in an exemplary manner in FIGS. 3 and 5. In the shown examples, each pressing device 5 is designed as an arrangement of a plurality of arc-segment-shaped pressing elements 6. In this instance, the design of pressing elements 6 may be adapted in an advantageous manner to the composition of the mixture of wastes to be processed. To this end, FIG. 4, for example, shows a pressing device 6, which has a planar area 7 facing tearing elements 2. Such a pressing element 6 is particularly suited to process small bags, in particular, bags having a capacity of at most 30 liters. Exemplary pressing device 5 illustrated in FIG. 6, in contrast, has a plurality of smaller individual pressing elements 6. These form a type of rake, which concavely curved side of its tine arrangement faces cylindrical rotational solid 4. Pressing elements 6 of individual pressing devices 5 are, via a suitable pre-tensioning mechanism, individually loaded by an elastic, hydraulic force and/or spring force, which presses pressing elements 6 against cylindrical rotational solid 4. In this instance, it is advantageously possible to shift pressing elements 6 from the previously described use state into a non-use state, in which pressing elements 6 are moved away from cylindrical rotational solid 4, so that a crevice of a defined width results between rotational solid 4 and pressing device 5. This may be advantageous, when mixtures of wastes having a plurality of large objects are to be processed.

Figure 7:
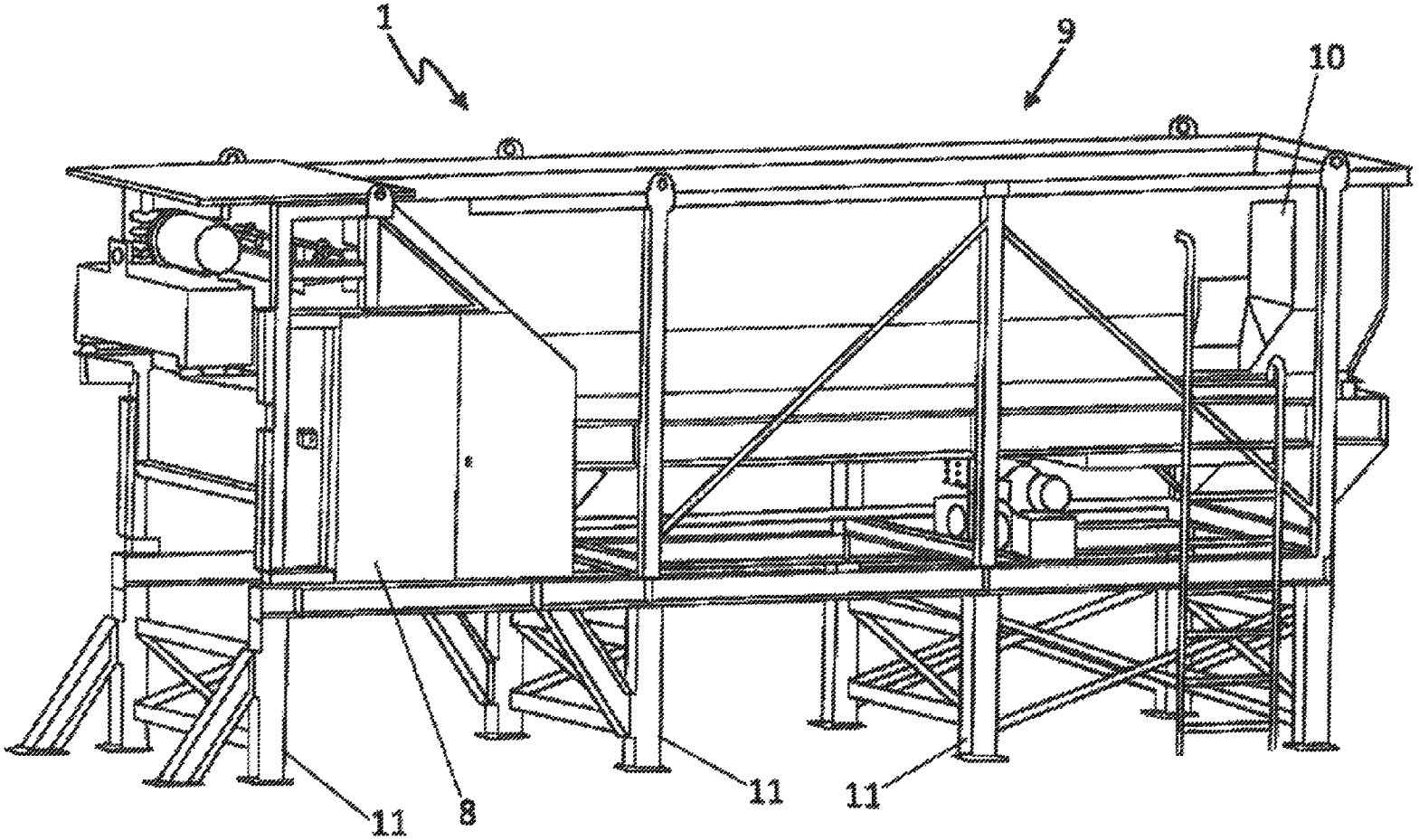
FIG. 7 shows an exemplary device according to the present invention having a feeding device.

FIG. 7 shows a device 1 of the art according to the present invention, which has a housing area 8, situated to the left in the illustration, for accommodating rotational solid 4 and pressing device 5. Subsequently, the bags are opened in this housing area 8. The larger part to the right of illustrated device 1 is occupied by a feed area 9. Said feed area is designed in a container-like manner and preferably accessible by a schematically illustrated service hatch 10. The design of feed area 9, which is open at the top end, enables to fill said feed area in a simple manner from the top. Feed area 9 advantageously has a feeding device (not shown), which is capable to convey the mixture of wastes into the operating area of cylindrical rotational solid 4 or of tearing elements 2. In this instance, the feeding device may preferably be a push floor, designed advantageously in a sealed fashion, that is, in which the individual elements of the push floor movable relative to one another, forming the support surface for the mixture of wastes accumulated on the push floor, are sealed relative to one another in such a manner that even the finest or most grainy components of the mixture of wastes to be processed are not able to pass through the push floor.

In an advantageous manner, the device is designed so that the mixture of wastes, after the bags have been opened, is able to exit device 1 downwards. For this purpose, device 1 is, in the shown example, set up in an advantageous manner on a frame 11, enabling that an apparatus for the removal of the mixture of wastes reaches under device 1, in particular, under the operating area of tearing elements 2. This apparatus may be a transport container as well as a trough or the like; however, a transporting device, for example, a conveyor belt, may also be situated in such a manner that this transporting device protrudes from underneath device 1 according to the present invention.

What is claimed is:

1. A device (1) for opening bags in mixtures of wastes, wherein the device (1) comprises:

a first group of tearing elements (2) for transferring tearing forces to bags;

a second group of tearing elements (2) for transferring tearing forces to bags, wherein the groups of tearing elements (2) is moved by a drive power in such a manner that a relative movement between tearing elements (2) of different groups generates tearing forces; and a drive control device, which is configured to control the drive power of at least one group of tearing elements (2) as a function of the as a function of a mass flow of the mixture of wastes fed into the device, whereby controlling the drive power in such a manner reduces the drive power upon a reduction of the mass flow of the mixture of wastes fed into the device and increases the drive power upon an increase of the mass flow of the mixture of wastes fed into the device.

2. The device (1) according to claim 1, wherein the drive control device is configured to control at least one of the movement speed, the angular velocity, the drive force, and the torque of the tearing elements.

3. The device (1) according to claim 1, further comprising a pressing device (5) for pressing the mixture of wastes, namely, the bags onto the tearing elements (2), wherein the pressing device (5) has a plurality of individual pressing elements (6) acting independently from one another upon the mixture of wastes.

4. The device (1) according to claim 3, wherein the pressing device (5), namely, the individual pressing elements (6), are designed in such a manner to give into extraneous materials getting between the tearing elements (2) and the pressing device (5) and are mounted in an elastic and/or hydraulic manner.

5. The device (1) according to claim 3, further comprising a pressing control device, which is configured to shift the pressing device (5) selectively into a use state or a non-use state.

6. The device (1) according to claim 1, further comprising a feeding device for feeding the mixture of wastes into the operating area of the tearing elements (2).

7. The device (1) according to claim 6, further comprising a feed control device for controlling the feeding device, which is configured to control the feeding speed of the mixture of wastes.

8. The device (1) according to claim 1, wherein the tearing elements are assigned in groups to carrier elements (3) and are situated at said carrier elements, wherein adjacent carrier elements (3) are moveable relative to one another.

9. A device (1) for opening bags in mixtures of wastes, wherein the device (1) comprises:

a first group of tearing elements (2) for transferring tearing forces to bags;

a second group of tearing elements (2) for transferring tearing forces to bags, wherein the groups of tearing elements (2) is moved by a drive power in such a manner that a relative movement between tearing elements (2) of different groups generates tearing forces;

a drive control device, which is configured to control the drive power of at least one group of tearing elements (2) as a function of the operating situation; and a superordinate control for actuating at least the drive control device, and which is configured to selectively enable different operating modes, wherein the drive control device is configured to control the drive power as a function of the mass flow of the fed mixture of wastes.

10. The device (1) according to claim 6, wherein the feeding device is a push floor.

11. The device (1) according to claim 8, wherein the carrier elements (3) are annular.

12. The device (1) according to claim 9, wherein the drive control device is configured to control at least one of the movement speed, the angular velocity, the drive force, and the torque of the tearing elements.

13. The device (1) according to claim 9, further comprising:

a pressing device (5) for pressing the mixture of wastes, namely, the bags onto the tearing elements (2), wherein the pressing device (5) has a plurality of individual pressing elements (6) acting independently from one another upon the mixture of wastes; and a pressing control device, which is configured to shift the pressing device (5) selectively into a use state or a non-use state, wherein the superordinate control is for actuating at least one of the drive control device and the pressing control device.

14. The device (1) according to claim 13, wherein the pressing device (5), namely, the individual pressing elements (6), are designed in such a manner to give into extraneous materials getting between the tearing elements (2) and the pressing device (5) and are mounted in an elastic and/or hydraulic manner.

15. The device (1) according to claim 9, further comprising:

a feeding device for feeding the mixture of wastes into the operating area of the tearing elements (2); and a feed control device for controlling the feeding device, which is configured to control the feeding speed of the mixture of wastes, wherein the superordinate control is for actuating at least one of the drive control device and the feed control device.

16. The device (1) according to claim 9, wherein the tearing elements are assigned in groups to carrier elements (3) and are situated at said carrier elements, wherein adjacent carrier elements (3) are moveable relative to one another.

17. The device (1) according to claim 15, wherein the feeding device is a push floor.

18. The device (1) according to claim 16, wherein the carrier elements (3) are annular.

19. A device (1) for opening bags in mixtures of wastes, wherein the device (1) comprises:

a first group of tearing elements (2) for transferring tearing forces to bags;

a second group of tearing elements (2) for transferring tearing forces to bags, wherein the groups of tearing elements (2) is moved by a drive power in such a manner that a relative movement between tearing elements (2) of different groups generates tearing forces;

a drive control device, which is configured to control the drive power of at least one group of tearing elements (2) as a function of the operating situation;

a pressing device (5) for pressing the mixture of wastes, namely, the bags onto the tearing elements (2), wherein the pressing device (5) has a plurality of individual pressing elements (6) acting independently from one another upon the mixture of wastes;

a pressing control device, which is configured to shift the pressing device (5) selectively into a use state or a non-use state;

a feeding device for feeding the mixture of wastes into the operating area of the tearing elements (2);

a feed control device for controlling the feeding device, which is configured to control the feeding speed of the mixture of wastes; and a superordinate control for actuating at least one of the drive control device, the pressing control device, and the feed control device, which is configured to selectively enable different operating modes, wherein the drive control device is configured to control the drive power as a function of the mass flow of the fed mixture of wastes.

20. The device (1) according to claim 19, wherein the drive control device is configured to control at least one of the movement speed, the angular velocity, the drive force, and the torque of the tearing elements.

21. The device (1) according to claim 19, wherein the pressing device (5), namely, the individual pressing elements (6), are designed in such a manner to give into extraneous materials getting between the tearing elements (2) and the pressing device (5) and are mounted in an elastic and/or hydraulic manner.

22. The device (1) according to claim 19, wherein the tearing elements are assigned in groups to carrier elements (3) and are situated at said carrier elements, wherein adjacent carrier elements (3) are moveable relative to one another.

* * * * *